US006843853B2

(12) United States Patent
Miskech et al.

(10) Patent No.: US 6,843,853 B2
(45) Date of Patent: Jan. 18, 2005

(54) MATERIAL APPLICATOR ASSEMBLY AND A METHOD FOR USING THE SAME

(75) Inventors: Peter Miskech, Dearborn, MI (US); Joseph Paul Tekelly, Troy, MI (US); David Gary Dahlstrom, Grosse Pointe Farms, MI (US); Keith Alan Kuzmich, Commerce Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 152 days.

(21) Appl. No.: 10/248,900

(22) Filed: Feb. 28, 2003

(65) Prior Publication Data

US 2004/0168629 A1 Sep. 2, 2004

(51) Int. Cl.[7] ..... B05C 11/00
(52) U.S. Cl. ..... 118/264; 118/258; 118/216
(58) Field of Search ..... 118/264, 268, 118/267, 216, 225, 258, 244, 260, 118, 109, 123, 110, 112, DIG. 15; 15/230, 230.16; 401/197, 198, 208; 222/548; 492/24; 156/578; 425/6, 365, 331

(56) References Cited

U.S. PATENT DOCUMENTS 4,623,307 A * 11/1986 Froeschke ..... 425/8

* cited by examiner

*Primary Examiner*—Brenda A. Lamb
(74) *Attorney, Agent, or Firm*—Brooks & Kushman, P.C.; Raymond L. Coppiellie

(57) ABSTRACT

A material applicator assembly 10 which includes a rotor member 12 having a plurality of dispenser apertures 20 and a deformable material application ring 23 around the outer periphery of the rotor member 12. The assembly 10 being rotatably coupled to a centrally mounted tubular member 40. Member 40 having at least one aperture through which an adhesive material 45 is forced into each of the plurality of apertures 20 as the rotor member 12 is rotated about member 40, thereby injecting the adhesive material 45 into the application ring 23 to deposit the adhesive material 45 upon components 60 having varying cross-sectional shapes.

16 Claims, 3 Drawing Sheets

MATERIAL APPLICATOR ASSEMBLY AND A METHOD FOR USING THE SAME

BACKGROUND OF INVENTION

1. Field of the Invention

The present invention generally relates to a material applicator assembly and to a method for using the material applicator assembly and more particularly, to a rotatable material applicator assembly which is selectively dispenses an amount of adhesive in an efficient and secure manner.

2. Background of the Invention

A commercial assembly line typically includes means for applying an amount of adhesive to particular locations of the components being assembled.

These conventional adhesive applicators typically include a plurality of glue emitters or "guns" which deposit an amount of glue upon certain portion or portions of a component as it passes along the assembly line. These glue guns are oftentimes rigidly fixed along the line and are operated by selectively forcing an amount of glue out of the gun when the component is positioned in the appropriate location relative to the gun. While this system and method does deposit glue in the intended location, it suffers from certain drawbacks.

Particularly, many surfaces which are adhesively bonded are not flat and/or do not have a uniform profile. Oftentimes, however, an amount of material, such as glue, is required along the entire length of a relatively large (i.e., long) component having such a non-uniform profile and the effectiveness of glue guns is limited by the size, location, and shape of the nozzles of the glue guns. These "irregular" surfaces cause conventional applicator guns to undesirably place either too much or too little adhesive (or other material) upon the different contours of objects that are not flat. Because of this, the applicator nozzles must be positioned precisely where the material is intended to be deposited along the length of the object. This type of precision requires a relatively slow component flow rate through the assembly line and "bottle-necks" are therefore formed at gluing stations unless more glue guns are employed, which undesirably increases the costs involved in the assembly process.

Other methodologies used to eliminate this relatively slow component flow rate include keeping the glue gun continuously "on" while the component is passing through the station instead of intermittently turning the gun on and off. While this methodology permits higher flow rate, it causes undesirable causes waste of glue by exceeding the required amounts necessary for an effective bond and/or undesirably deposits glue upon portions of the component which must be cleaned off later.

The present invention overcomes these and other disadvantages of the present invention in a new and novel manner.

SUMMARY OF INVENTION

It is a first non-limiting advantage of the present invention to provide a material dispensing assembly which overcomes some or all of the previously delineated disadvantages of prior material dispensing assemblies.

It is a second non-limiting advantage of the present invention to provide an adhesive material dispensing assembly which deposits a uniform amount of adhesive across the entire surface of an irregularly shaped object.

It is a third non-limiting advantage of the present invention to provide an adhesive material dispensing assembly having a sponge or mesh applicator which conforms to the shape of an object as adhesive is applied by the sponge or mesh applicator.

It is a fourth non-limiting advantage of the present invention to provide an adhesive material dispensing assembly Particularly, the provided adhesive material dispensing assembly includes a first rotor having a plurality of outer dispensing apertures and a plurality of inner dispensing apertures wherein each of said plurality of inner dispensing apertures communicates with a unique one of said plurality of outer dispensing apertures; first and second substantially identical end portions, wherein said first end portion is attached to a first edge of said rotor portion and wherein said second end portion is attached to a second edge of said rotor portion; a member which extends through said first and second substantially identical end portions and through said rotor portion and which is movably coupled with said first and second substantially identical end portions and said rotor portion, said member having at least one aperture which is selectively and sequentially aligned with each of said inner dispensing apertures as said member is moved with said first and second substantially identical end portions and said first portion, thereby allowing material to be emitted from said plurality of outer dispensing apertures in a certain sequence.

It is a fifth non-limiting advantage of the present invention to provide a material applicator. Particularly, the provided material applicator includes a wheel having a depressed central portion, said depressed central portion having a first outer surface having a plurality of material dispensing apertures and further having a second inner surface having a second plurality of material dispensing apertures, each of said second plurality of material dispensing apertures being communicatively aligned with a unique one of said first plurality of apertures; and a generally hollow member which is movably received with said wheel and which includes an open end which is selectively and communicatively coupled to a source of material, said generally hollow member further having at least one aperture which communicates with said open end and which is selectively and sequentially aligned with each of said second plurality of material dispensing apertures.

It is a sixth non-limiting advantage of the present invention to provide a method for dispensing an adhesive material. Particularly, the method includes the steps of providing a first rotor member having a plurality of material dispensing apertures; providing a generally hollow member having at least one material dispensing apertures; movably disposing said generally hollow member within said first rotor member; communicatively coupling said generally hollow member to a source of material; rotating said first rotor member about said generally hollow member, effective to cause said at least one material dispensing aperture of said generally hollow member to be sequentially aligned with each of the plurality of material dispensing apertures which are found upon said first rotor member as said first rotor member is rotated.

These and other features and advantages of the present invention will become apparent from a reading of the following detailed description of the preferred embodiment of the invention and by reference to the following drawings.

DETAILED DESCRIPTION

Figure 1:
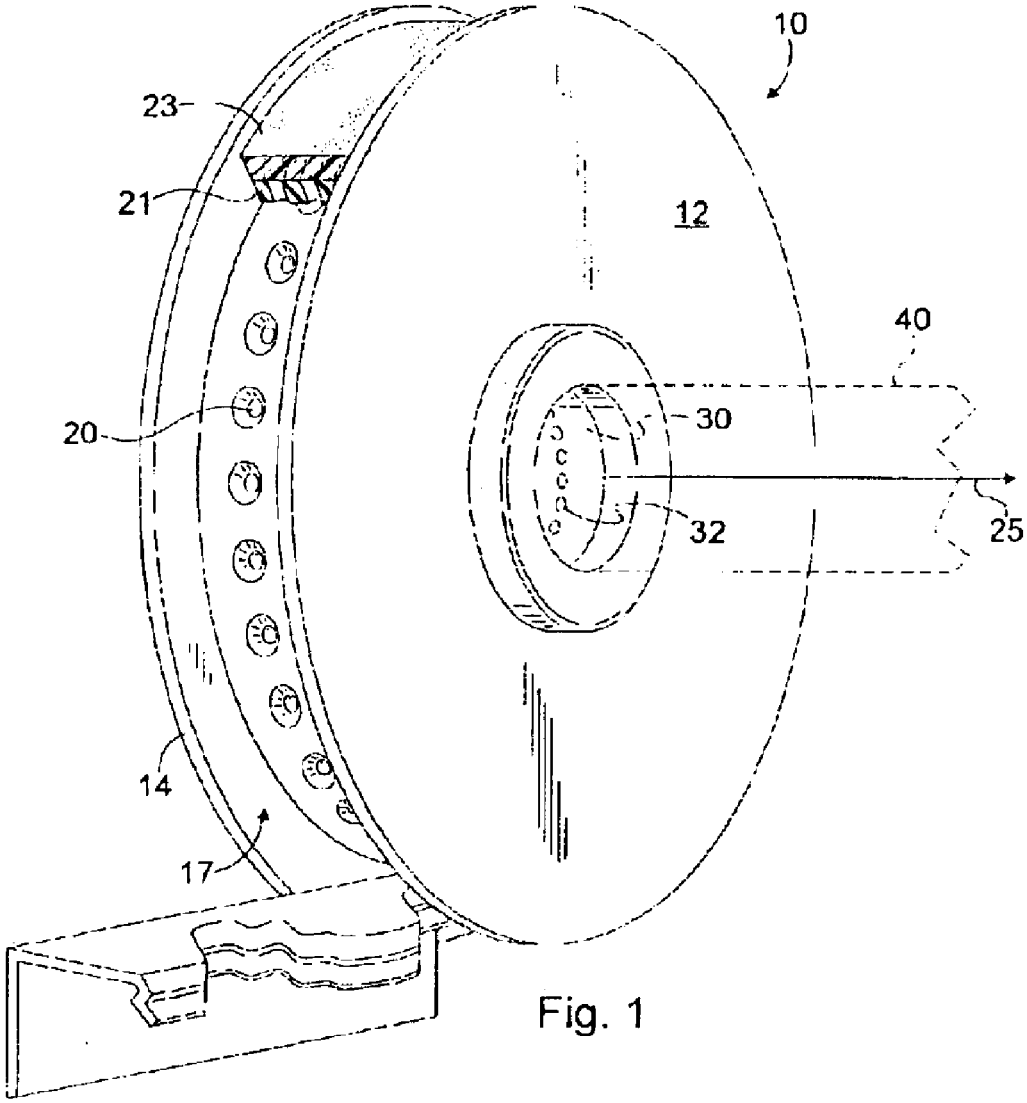
FIG. 1 is a perspective partial cut-away view of an adhesive material dispensing assembly which is made in accordance with the teachings of the preferred embodiment of the invention.
Figure 2:
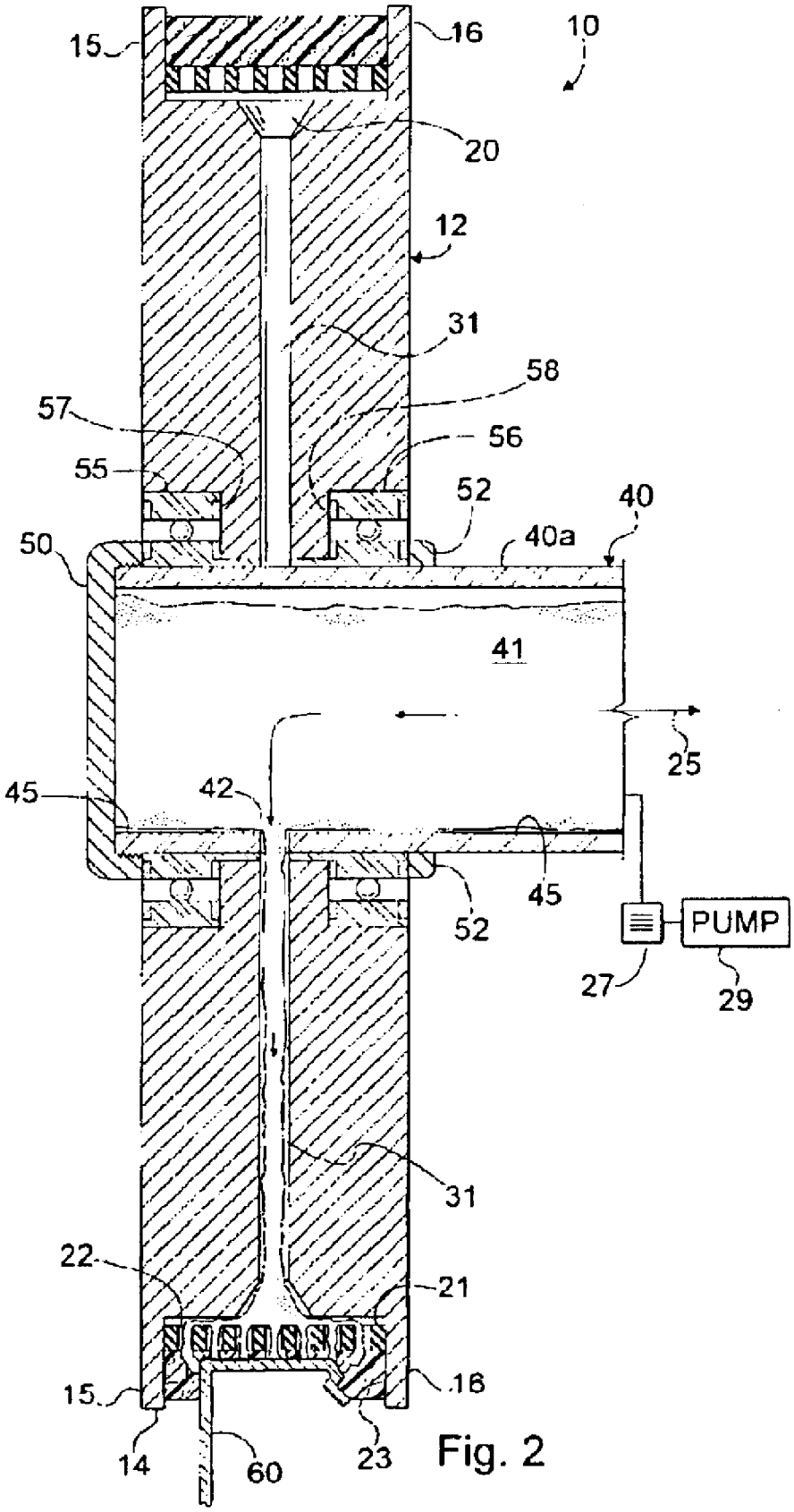
FIG. 2 is a sectional front view of the adhesive material dispensing assembly which is generally shown in FIG. 1.

Referring now to FIGS. 1 and 2, there is shown an adhesive application assembly 10 which is made in accordance with the teachings of the preferred embodiment of the invention. Particularly, the adhesive application assembly 10 includes a generally round wheel or rotor portion 12 which is constructed of a relatively durable and rigid material, such as a metal. A centrally located recessed portion, channel, or trough 17 is formed substantially around the outer edge 14 of rotor 12, thereby forming a pair of substantially identical side walls 15, 16. As shown, recessed portion 17 is formed around the entire circumference of rotor 12 and has a uniform depth.

A plurality of equally spaced outer dispenser holes or apertures 20 are formed within rotor 12 along channel 17. In the preferred embodiment of the invention, each outer dispenser hole 20 tapers from a relatively wide outer diameter to a narrower inner diameter.

Furthermore, an aperture 30 is formed in rotor 12 along the rotational axis 25 of rotor 12. A plurality of equally spaced inner dispensing holes or apertures 32 are disposed within rotor 12 around the circumference of aperture 30. As best shown in FIG. 2, each of the outer dispenser holes 20 is aligned with and communicatively coupled to a unique one of the inner apertures 32 by a dispensation channel 31, thereby communicatively coupling aperture 30 to trough 17.

Assembly 10 further includes a generally tubular bar or member 40. Member 40 is sized to "slip-fit" within aperture 30 of rotor 12. That is, the inner surface 13 of rotor 12 and the outer surface 40*a* of member 40 are disposed in relatively close proximity to each other and are of approximately the same size dimensionally (e.g., the diameter of member 40 is approximately a few thousandths of an inch smaller than the diameter of aperture 30). This slip fit arrangement of member 40 to rotor 12 permits rotor 12 to rotate about member 40 (i.e., rotate about rotational axis 25).

Member 40 includes at least one aperture 42 which is substantially aligned with the plurality of inner apertures 32 formed in the rotor 12. It should be appreciated that as rotor 12 is rotated about member 40, a unique one of the plurality of apertures 32 are aligned with aperture 42 to intermittently and communicatively couple the generally hollow inner portion 41 of tubular member 40 with trough 17.

An amount of conventional glue or adhesive 45 is disposed within portion 41 of member 40. Additionally, a pump assembly 29 and a source or supply 27 of adhesive 45 are communicatively coupled to member 40, effective to force adhesive 45 through aperture 42 and into each of the apertures 32 as each of these apertures 32 are brought into alignment with aperture 42.

As shown in FIG. 2 and in the preferred, although non-limiting, embodiment of the invention, assembly 10 further includes a pair of sealed bearings 55, 56 each having an outer race which is fixedly coupled to rotor 12. That is, bearings 55, 56 are disposed within a pair of cylindrical pockets which are formed within rotor 12 concentric to axis 25. The inner races of bearing 55, 56 are fixedly coupled to the outer surface 40*a* of member 40, thereby allowing rotor 12 to easily rotate about member 40 with a minimum of frictional resistance. It should be appreciated that sealed bearing 55, 56 cooperate to ensure that adhesive 41 is retained within member 40 and rotor 12. In other non-limiting embodiments, assembly 10 may further include seals or o-rings 57, 58 which may be disposed between the bearing 55, 56 and rotor 12, effective to prevent or seal adhesive 45 from seeping or exiting from assembly 10 except through aperture(s) 20. Additionally, assembly 10 may further include a first end portion 50 which is removably coupled to member 40 and a second end portion 52 which is also coupled to the member 40 in a conventional manner. End portions 50, 52 cooperatively and concomitantly hold rotor 12 in position relative to member 40 (i.e., portions 50, 52 maintain the alignment of aperture 42 to apertures 32). End 50 further acts as a "cap" or seal which retains material 45 within member 40. It should be understood that portions 50, 52 may be coupled to member 40 in substantially any manner. For example and without limitation, a portion of the outer surface 40*a* and end portions 50, 52 may be threaded to allow a user to position rotor 12 along the length of member 40.

Assembly 10 further includes a ring or band 21 of an elastomeric material, such as rubber, which is disposed within trough 17 of rotor 12. That is, ring 21 is fitted within trough 17, between side walls 15, 16 and substantially covering outer apertures 20. As best shown in FIG. 2, ring 21 includes a plurality of apertures or perforations 22 which interconnect the inner diameter of ring 21 to the outer diameter of ring 21 along the entire circumference and width of ring 21.

Adhesive dispensing assembly 10 further includes a second ring or band 23 which is disposed within trough 17 and abuttingly engages the perforated rubber ring 21. Ring 23 is formed from a mesh, sponge, or any other absorbent material, effective to partially absorb and retain an adhesive material which is inserted within it. It should be appreciated that sponge 23 is elastically deformable and will conform to substantially any relatively rigid object it may come into contact with. As shown in FIG. 2, this arrangement of components 40, 12, 21, and 23 permits an adhesive 45 (or other material) to pass through aperture 42 in member 40 into inner dispenser aperture 32, through channel 31 and outer dispenser aperture 20. Adhesive 45 then passes through the perforations 22 in elastomeric ring 21 and into sponge 23. When an object, such as component 60, frictionally engages sponge 23, sponge 23 is effective to uniformly deposit, apply, or "wet" adhesive 45 upon the component 60.

Figure 3:
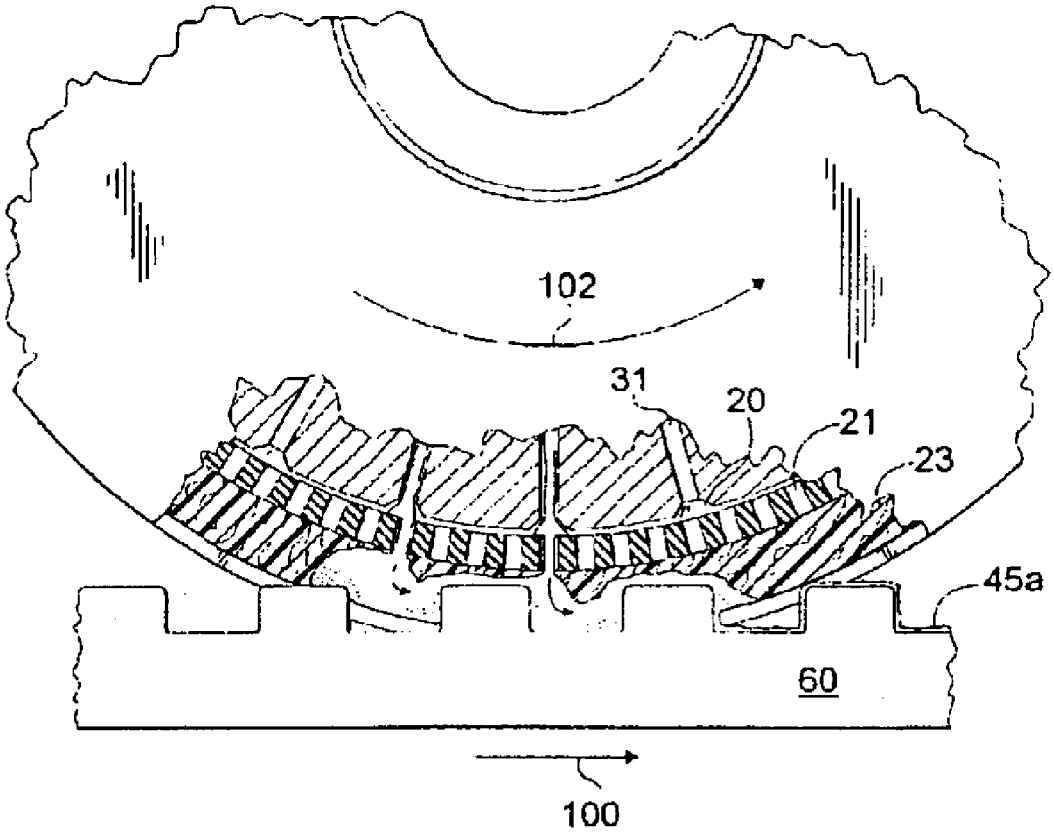
FIG. 3 is an operational and partial cut-away side view of a portion of the adhesive material dispensing assembly which is generally shown in FIGS. 1 and 2.

In operation, and as is best shown in FIGS. 2 and 3, adhesive dispensing assembly 10 is disposed as a part of a conventional assembly line (not shown), wherein a component or part 60 passes. Assembly 10 is disposed in a position to frictionally engage component 60 along sponge 23 substantially between side walls 15, 16. As component 60 is passed along the assembly line in the direction of arrow 101, the frictional engagement of sponge 23 with the component 60 causes rotor 12 to rotate about member 40 in the direction of arrow 102 at substantially the same rate of speed that component 60 is traveling.

As component 60 is moving in direction 100 and rotor 12 is turning in direction 102, member 40 is rigidly held in place to cause aperture 42 to have a substantially constant orientation relative to component 60. That is, in the preferred non-limiting embodiment of the invention shown in FIGS. 2 and 3, the aperture 42 is oriented "down" toward component 60. It should be appreciated that when rotor 12 is rotated about member 40 by the frictional engagement of component 60 to sponge 23, a unique one of the plurality of apertures 32 is temporarily aligned with aperture 42. Pump assembly 29 is operated in a conventional manner to maintain a constant pressure within the adhesive 45 containing hollow portion 41 of member 40, an amount of adhesive 45*a* will be passed through aperture 42 into the aperture 32 which is aligned with aperture 42. This amount of adhesive 45*a* passes through channel 31 and out of outer dispensing aperture 20. Adhesive 45 passes through perforations 22 contained within ring 21 and into sponge 23, thereby "wetting" or filling the sponge 23 with adhesive. As component 60 passes by assembly 10, the frictional engagement of sponge 23 to component 60 deposits a relatively even and uniform amount of adhesive 45*a* onto component 60. As best shown in FIG. 3, sponge 23 deforms to conform with the shape of component 60, while depositing the adhesive 45*a* onto the component 60.

It should be appreciated that by conforming to the shape of the particular component 60, sponge 23 permits assembly 10 to apply adhesive 45 evenly upon the component 60, even if it is not flat or has an irregular cross-section. It should further be appreciated that the use of a limited number of apertures 42 within member 40, assembly 10 avoids depositing or emitting adhesive 45 upon unintended surfaces. That is, only the channels 31 and outer apertures 20 which are aligned with a portion of the sponge 23 that is actually coming into contact with the component 60 receive adhesive 45 from the supply 27. It should further be appreciated that trough 17 permits deposition of adhesive 45 onto component 60 without any of the adhesive coming into contact with the outer portions of rotor 12.

It is to be understood that the invention is not limited to the exact construction and method which has been described above, but that various changes and modifications may be made without departing from the spirit and the scope of the inventions as are more fully delineated in the following claims. For example and without limitation, member 40 may includes more than one aperture 42 to permit assembly 10 to simultaneously dispense adhesive material 45 upon multiple components (e.g., a separate component may be passed in close proximity "above" rotor 12 while another component 60 also frictionally engages sponge 23 of assembly 10.

In another non-limiting embodiment, member 20 may include a second aperture which is substantially the same as aperture 42 which allows a second amount of adhesive 45 to be emitted into another channel 31 and aperture 20 of rotor 12. That is, a second aperture 42 may be formed to allow glue 45 to be emitted through two apertures 20 simultaneously. As shown in FIG. 3, using two apertures in member 40 permits assembly 10 to inject an amount of adhesive 45 into sponge 23 before it physically contacts the component 60, thereby filling or "pre-wetting" the sponge 23. Pre-wetting the sponge 23 at a location 103 which is about to come into contact with component 60 ensures that sponge 23 has enough adhesive 45 to thoroughly cover the component 60 with adhesive 45 and increases the "gripping" or frictional force of sponge 23 as the component 60 passes to cause rotor 12 to rotate about member 40.

In other non-limiting embodiments apertures 32, channels 31, and apertures 20 are not equally spaced, but are spaced according to a desired adhesive deposition pattern which is dependent upon the shape and/or configuration of the component. In other non-limiting embodiments, pump assembly 29 may be intermittently and selectively engaged to provide pressure "on-demand" or only when a component 60 is frictionally engaging rotor 12.

In another non-limiting embodiment of the invention, rotor 12 of assembly 10 may be coupled to a conventional motor assembly and a controller (not shown) which are effective to cause rotor 12 to rotate a certain amount as a component 60 is passed "under"the rotor 12, thereby alleviating the frictional wear on mesh 23. That is, rotor 12 may be synchronized by the controller to rotate a predetermined number of revolutions upon the introduction of a component 60 to the assembly 10, thereby whetting the component 60 with material 45 while substantially eliminating any potential of having mesh 23 slipping or "losing grip" on component 60 as it is passed under rotor 12.

It should be appreciated that, in the foregoing manner, assembly 10 deposits an amount of adhesive 45*a* upon a component 60 having a non-uniform or varying shape in a substantially uniform manner.

What is claimed is:

1. A material applicator comprising:

a rotor portion having a plurality of outer dispensing apertures and a plurality of inner dispensing apertures wherein each of said plurality of inner dispensing apertures communicates with a unique one of said plurality of outer dispensing apertures;

a member which extends through said rotor portion and which is movably coupled with said rotor portion, said member having at least one aperture which is selectively and sequentially aligned with each of said inner dispensing apertures as said rotor portion is rotated about said member, thereby allowing material to be emitted from said plurality of outer dispensing apertures in a certain sequence;

a perforated elastomeric ring which is coupled to said rotor and which substantially covers each of said plurality of outer dispensing aperture; and a deformable sponge ring which is coupled to and which covers said perforated elastomeric ring, effective to allow said material to pass through said perforated elastomeric ring and into said sponge ring.

2. The material applicator of claim 1 wherein said rotor portion is substantially round.

3. The material applicator of claim 2 wherein said member is generally round and hollow.

4. The material applicator of claim 3 further comprising a first o-ring and a second o-ring which cooperate to sealingly align said plurality of apertures in said rotor with said at least one aperture in said member.

5. The material applicator of claim 4 further comprising a source of material which is selectively and communicatively coupled to said member.

6. The material applicator of claim 5 wherein said material comprises glue.

7. The material applicator of claim 6 further comprising a pump which selectively and forcibly causes said glue to enter said member.

8. A material applicator comprising:

a wheel having a depressed central portion and a first inner surface having a first plurality of material dispensing apertures, said depressed central portion having a second outer surface having a second plurality of material dispensing apertures, wherein each of said second plurality of material dispensing apertures is communicatively aligned with a unique one of said first plurality of apertures;

a generally hollow member which is movably received by said inner surface of said wheel and which includes an open end which is selectively and communicatively coupled to a source of material, said generally hollow member further having at least one aperture which communicates with said open end and which is selectively and sequentially aligned with each of said first plurality of material dispensing apertures; and at least one material application layer which is disposed within said depressed central portion of said wheel.

9. The material applicator of claim 8 wherein said depressed central portion has a uniform depth.

10. The material applicator of claim 9 wherein each of said second plurality of material disposing apertures are equidistantly positioned upon said second outer surface.

11. The material applicator of claim 8 wherein said at least one material applicator layer comprises:

a first perforated rubber ring which is disposed upon said wheel; and a material applicator ring which is disposed upon said perforated rubber ring.

12. The material applicator of claim 11 wherein said perforated rubber ring is communicatively coupled to said second plurality of material dispensing apertures.

13. The material applicator of claim 12 wherein said material applicator ring comprises a sponge material.

14. The material applicator of claim 12 wherein said material applicator ring comprises a mesh material.

15. The material applicator of claim 11 further comprising a pump which selectively and forcibly causes said material to enter said member.

16. The material applicator of claim 11 wherein said material comprises glue.

* * * * *